US009058964B2

(12) United States Patent
Makarov et al.

(10) Patent No.: US 9,058,964 B2
(45) Date of Patent: Jun. 16, 2015

(54) MASS SPECTROMETER POWER SOURCES WITH POLARITY SWITCHING

(75) Inventors: Alexander A. Makarov, Bremen (DE); Alexander Kholomeev, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 317 days.

(21) Appl. No.: 12/992,557

(22) PCT Filed: Jun. 1, 2009

(86) PCT No.: PCT/GB2009/001353

§ 371 (c)(1),
(2), (4) Date: Jan. 14, 2011

(87) PCT Pub. No.: WO2009/144469

PCT Pub. Date: Dec. 3, 2009

(65) Prior Publication Data

US 2011/0101218 A1 May 5, 2011

(30) Foreign Application Priority Data

May 30, 2008 (GB) ..... 0809950.9

(51) Int. Cl.
*H01J 49/02* (2006.01)
*H01J 49/00* (2006.01)

(52) U.S. Cl.
CPC ..... *H01J 49/022* (2013.01); *H01J 49/0031* (2013.01)

(58) Field of Classification Search
CPC . H01J 49/0031; H01J 49/004; H01J 49/0095; H01J 49/0081
USPC ..... 250/281, 282, 287, 288, 290, 291, 292; 323/205, 209, 266, 268; 307/112, 124
See application file for complete search history.

(56) References Cited

U.S. PATENT DOCUMENTS 3,621,464 A * 11/1971 Bryndza et al. ..... 331/106
5,401,965 A * 3/1995 Kaneko et al. ..... 850/43

(Continued)

FOREIGN PATENT DOCUMENTS

CN 1926657 A 3/2007
JP 2001035436 2/2001

(Continued)

OTHER PUBLICATIONS

Vishwanathan, Ramanarayanan, "Industrial Electronics Society," The 29th Annual Conference of the IEEE, Piscataway, NJ (2003), pp. 2747-2752.

*Primary Examiner* — Brooke Purinton
(74) *Attorney, Agent, or Firm* — Charles B. Katz

(57) ABSTRACT

A method of switching between two modes of power supply to a mass analyzer is provided. In a first mode of operation, operated for a first predefined time duration, a first power supply, coupled to the mass analyzer, generates a first non ¬ zero potential, while a second power supply, disconnected from the mass analyzer, generates a second non-zero potential. In a second mode of operation, operated for a second predefined time duration, the second potential is coupled to the mass analyzer, while the first power supply, disconnected from the mass analyzer, generates the first potential. These predefined time durations are selected such that only one of: the first potential; and the second potential is coupled to the mass analyzer at any time, and such that the first and second modes of operation are carried out at least once within a predetermined length of time.

16 Claims, 7 Drawing Sheets

(56) References Cited

U.S. PATENT DOCUMENTS

| | | | | |
|---|---|---|---|---|
| 5,402,059 | A | 3/1995 | Bittar | |
| 5,689,111 | A * | 11/1997 | Dresch et al. | 250/287 |
| 6,172,492 | B1 * | 1/2001 | Pletcher et al. | 323/284 |
| 6,541,765 | B1 * | 4/2003 | Vestal | 250/282 |
| 6,541,769 | B1 | 4/2003 | Takada et al. | |
| 6,600,155 | B1 * | 7/2003 | Andrien et al. | 250/287 |
| 6,724,157 | B2 * | 4/2004 | Kazanov et al. | 315/291 |
| 6,831,271 | B1 * | 12/2004 | Guevremont et al. | 250/282 |
| 7,064,529 | B2 * | 6/2006 | Telecco | 323/267 |
| 7,385,377 | B2 * | 6/2008 | Pisasale et al. | 323/267 |
| 7,560,913 | B2 * | 7/2009 | Petrowsky et al. | 323/266 |
| 2002/0100870 | A1 * | 8/2002 | Whitehouse et al. | 250/281 |
| 2002/0167299 | A1 * | 11/2002 | Curtin | 323/266 |
| 2004/0084613 | A1 * | 5/2004 | Bateman et al. | 250/281 |
| 2004/0217285 | A1 * | 11/2004 | Smith et al. | 250/292 |
| 2005/0258364 | A1 * | 11/2005 | Whitehouse et al. | 250/292 |
| 2007/0069120 | A1 * | 3/2007 | Shvartsburg et al. | 250/287 |
| 2008/0073502 | A1 * | 3/2008 | Schneider et al. | 250/282 |
| 2008/0106241 | A1 * | 5/2008 | Deaver et al. | 323/209 |
| 2008/0111068 | A1 * | 5/2008 | Zabrouskov | 250/282 |
| 2008/0197275 | A1 * | 8/2008 | Mordehai et al. | 250/287 |
| 2009/0294654 | A1 * | 12/2009 | Steiner | 250/283 |

FOREIGN PATENT DOCUMENTS

| | | | |
|---|---|---|---|
| JP | 2007173228 | | 7/2007 |
| WO | WO 00/38304 | A1 | 6/2000 |
| WO | WO 01/29875 | A2 | 4/2001 |
| WO | WO 02/50866 | A2 | 6/2002 |
| WO | WO 2005/024882 | A2 | 3/2005 |
| WO | WO 2005/083742 | A2 | 9/2005 |
| WO | WO 2005/083743 | A2 | 9/2005 |
| WO | WO 2005/114705 | A2 | 12/2005 |

* cited by examiner

MASS SPECTROMETER POWER SOURCES WITH POLARITY SWITCHING

TECHNICAL FIELD OF THE INVENTION

This invention relates to a mass spectrometer for performing accurate mass analysis of both positively-charged and negatively-charged ions, and a method of providing a potential to a mass analyser of such a mass spectrometer.

BACKGROUND TO THE INVENTION

Many mass analysers that provide accurate mass measurements use electrostatic fields that are generated by high voltage power supplies. In some applications, for example liquid chromatography mass spectrometry (LC/MS) with ionisation at atmospheric pressure, the ionisation efficiency of particles for analysis may be optimal at different polarities. In such cases, analysis of all ions demands that the polarity of the electrostatic field of the mass analyser be switched. For accurate mass analysis, it is desirable that the stability of the electrostatic field be maximised.

Some existing technologies provide both positive and negative potentials using one or more power supplies having the same polarity. Polarity switching can then be achieved by powering down the entire high voltage network, switching relays to invert the polarity of the power supply output, and powering up the high voltage network again. Pulser wiring or triggering may also require adjustment. Moreover, a different feedback resistor chain may be used for voltage regulation, between different polarities. Heating and stabilisation of the entire network, once it has been powered up may take a number of hours. During this time, when the potentials provided for generating the electrostatic field may be unstable, accuracy of the mass analyser is poor for these reasons. WO-2004/107388 and WO-2008/081334 also illustrate schemes for injection of ions into a mass analyser that require stable and accurate potentials.

A high-voltage power supply with improved switching speed is described in WO-A-2007/029327. This is designed for powering a conversion dynode. Two power supplies are used, each providing a voltage with an opposite polarity with respect to the other. The polarity of the power supply output is changed by powering down the supply providing the unwanted polarity and regulating the other power supply output at the desired level. The polarity switching-speed is therefore improved by sacrificing accuracy of the output voltage.

SUMMARY OF THE INVENTION

Against this background, the present invention provides a method of switching between first and second modes of power supply to a mass analyser, comprising: in a first mode of operation, coupling a first non-zero potential generated by a first power supply to the mass analyser, whilst a second power supply generates a second non-zero potential but is disconnected from the mass analyser; in a second mode of operation, coupling the second non-zero potential generated by the second power supply to the mass analyser, whilst the first power supply generates the first potential but is disconnected from the mass analyser; operating in the first mode of operation for a first predefined time duration; and operating in the second mode of operation for a second predefined time duration. The first predefined time duration and second predefined time duration are selected such that only one of: the first potential; and the second potential is coupled to the mass analyser at any time, and such that the steps of operating in the first mode of operation and the second mode of operation are carried out at least once within a predetermined length of time.

Using two continuously operating power supplies means that a potential from each power supply is continuously and immediately available, despite the fact that the power supplies are never connected at the same time. This mitigates the problem of switching delay, when a power supply needs to be powered up in order for another potential to be generated.

However, if a power supply is held idle for too long a time, the stability of the power supply may degrade. In this context, "idle" refers to a power supply generating a non-zero potential, but disconnected from a load such that it supplies effectively zero current. By switching the mass analyser between the first power supply and second power supply such that both power supplies are connected to the mass analyser over a predetermined length of time, the average current provided by the first power supply and the average current provided by the second power supply are maintained at no less than a predetermined, non-zero level. The stability and therefore the accuracy of both power supplies is improved thereby. This switching is carried out independently of the analytical requirements of the mass analyser.

It is highly desirable that the impedance of the load to be presented to the power supply is matched to the impedance of the power supply. By regularly coupling the power supply that is not being used for mass analysis to the mass analyser, this advantageously maintains the stability of the potential generated by the power supply.

Thus, the power supplies can both provide accurate outputs, such that two high accuracy potentials are immediately available for switching therebetween. These advantages are particularly desirable when a significant recharge current together with high accuracy is needed for both potentials.

Preferably, the polarity of the first potential is opposite to that of the second potential. The two accurate potentials can therefore be used for the analysis of both positive and negative charged particles. Optionally, the first non-zero potential is equal in magnitude to the second non-zero potential.

In the preferred embodiment, the length of the second predefined time duration is no longer than the length of the first predefined time duration. Most preferably, the length of the first predefined time duration is substantially equal to the length of the second predefined time duration. In this way, the average current drawn by the two power supplies is similar.

Advantageously, the method further comprises receiving charged particles at the mass analyser during the first predefined time duration. Preferably, the method further comprises generating an electric field in the mass analyser using the first potential, so as to permit analysis of these charged particles thereby during the first predefined time duration. In this way, ions can be analysed using the accurate potential generated by one power supply.

Optionally, if the mass spectrometer is operated in the first mode of operation for a predefined number of times, particularly such that this predefined number of analyses of received charged particles is performed in the mass analyser, the mass spectrometer is not operated again in the first mode of operation without the mass spectrometer first being operated in the second mode of operation. Preferably, the predefined number of times is 100 or 20 or 10. More preferably, the predefined number of times is 3 or 2. Most preferably, the predefined number of times is 1. In this way the stability of the two power supplies is maintained at a substantially equal level. It is noted that typically only the switching process itself creates flow of current, and once the potential across the mass analyzer is constant, no current flows through the power supplies. The predetermined length of time is thereby related to the duration of a single mass analysis cycle.

It is an advantage that the length of the first predefined time duration is based on the length of time taken to perform the steps of receiving charged particles and analysing generating the electric field so as to permit analysis of the charged particles. In this way, the length of the first predefined time duration depends on the length of time required for an analysis. Preferably, the length of the second predefined time duration is no longer than the length of the first predefined time duration.

Beneficially, the length of the second predefined time duration is independent of the polarity of the charged particles received at the mass analyser during the first predefined time duration.

The predetermined length of time is preferably no greater than the sum of the length of the first predefined time duration and the length of the second predefined time duration.

Advantageously, the method further comprises generating a third potential of the same polarity as said first potential. The first mode of operation may then comprise coupling the first potential to the mass analyser, but not coupling the third potential to the mass analyser, during a first period of time, the first period of time being at least a portion of the first predefined time duration. Preferably, the first mode of operation also comprises coupling the first potential to the mass analyser and coupling the third potential to the mass analyser, during a second period of time, the second period of time being a portion of the first predefined time duration. In the preferred embodiment, the second period of time precedes the first period of time, and a power supply continues to generate the third potential during the first period of time. It is also advantageous that a power supply continues to generate the third potential during the second mode of operation.

The third potential is preferably generated by a third power supply, although alternatively, the first power supply may also generate the third potential. The stability and the accuracy of the first power supply is greater than that of the third power supply, if possible. The current flowing through the first potential is advantageously reduced thereby. Moreover, the magnitude of third potential is preferably greater than that of the first potential. This advantageously reduces unwanted parasitic oscillations (known as "ringing"), as the voltage step when the first potential is supplied is relatively small.

Also advantageously, the method may further comprise generating a fourth potential of the same polarity as the second potential. The second mode of operation may then comprise coupling the second potential to the mass analyser, but not coupling the fourth potential to the mass analyser, during a third period of time, the third period of time being a portion of the second predefined time duration. Preferably, the second mode of operation also comprises coupling the second potential to the mass analyser and coupling the fourth potential to the mass analyser, during a fourth period of time, the fourth period of time being portion of the second predefined time duration. In the preferred embodiment, the fourth period of time precedes the third period of time, and a power supply continues to generate the fourth potential during the third period of time. The third period of time and fourth period of time preferably follow the first period of time and second period of time, such that the first predefined time duration precedes the second predefined time duration. It is also advantageous that a power supply continues to generate the fourth potential during the first mode of operation (the first predefined time duration). The fourth potential is preferably generated by a fourth power supply, although alternatively, the second power supply may also generate the fourth potential. The stability and accuracy of the second power supply is greater than that of the fourth power supply, if possible. Moreover, the magnitude of fourth potential is preferably greater than that of the second potential.

In the preferred embodiment, the mass spectrometer is arranged to operate in the first predefined time duration in the first mode of operation, comprising the first time period and second time period, and in the second predefined time duration in the second mode of operation, comprising the third time period and fourth time period.

In the preferred embodiment, the mass analyser presents a substantially reactive load, its impedance being therefore predominantly imaginary in mathematical terms. In such cases, it will be recognised that a significant current only flows when the power supply is connected to the load. Hence, in order to maintain the stability of the supply, it is desirable that the power supply be connected to and disconnected from an impedance-matched load on a regular basis. Preferably, the mass analyser presents a substantially capacitive load, and more preferably, the mass analyser is of an Orbitrap type. Alternatively, the mass analyser is of a time of flight type, and optionally the mass analyser comprises an electrostatic trap. Optionally, the mass analyser presents a substantially inductive load.

In a further aspect, the present invention resides in a mass spectrometer, comprising: a mass analyser; a first power supply, arranged to generate a first potential; a second power supply, arranged to generate a second potential; a switch, having a first mode of operation in which the switch is arranged to couple the first potential to the mass analyser and to disconnect the second potential from the mass analyser, and a second mode of operation in which the switch is arranged to couple the second potential to the mass analyser and to disconnect the first potential from the mass analyser; and a controller, arranged to configure the switch to its first mode of operation for a first predefined time duration, and to configure the switch to its second mode of operation for a second predefined time duration, the first predefined time duration and second predefined time duration being selected such that such that the first mode of operation and the second mode of operation are carried out at least once within a predetermined length of time. The second power supply is arranged to continue to generate the said second potential when the switch is arranged in its first mode of operation and the first power supply is arranged to continue to generate the said first potential when the switch is arranged in its second mode of operation.

In a yet further aspect of the present invention, there is provided a method of providing a potential to a mass analyser of a mass spectrometer, the method comprising: generating a first potential from a first power supply; generating a second potential from a second power supply; switching from a first mode of operation, in which the first potential is coupled to the mass analyser, to a second mode of operation in which the first potential is not coupled to the mass analyser, but the first power supply continues to generate the said first potential; and switching from a third mode of operation, in which the second potential is coupled to a dummy load, to a fourth mode of operation, in which the second potential is not coupled to the dummy load, but the second power supply continues to generate the said second potential. The step of switching from said first mode of operation to said second mode of operation, and the step of switching from said third mode of operation to said fourth mode of operation each occur at least once during a predetermined length of time.

The predetermined length of time may be established as explained above in respect of other aspects of the present invention. Preferably, the mass analyser has a characteristic impedance and the dummy load has the characteristic impedance of the mass analyser.

In an embodiment, the first potential is of opposite polarity to the second potential. Then, the method optionally further comprises, during the second mode of operation, switching from the third mode of operation or the fourth mode of operation to a fifth mode of operation, in which the second potential is coupled to the mass analyser.

In some embodiments, the method further comprises switching from the first mode of operation or the second mode of operation to a sixth mode of operation, in which the first potential is coupled to a second dummy load. Where the third mode of operation and the sixth mode of operation do not occur at the same time, the second dummy load is optionally the same as the first dummy load.

Preferably, the method further comprises: generating a third potential from a third power supply; and switching from a seventh mode of operation in which the third potential is coupled to the mass analyser, to an eighth mode of operation in which the third potential is not coupled to the mass analyser. Advantageously, the third potential has the same polarity as the first potential and the seventh mode of operation is used whilst the first mode of operation is used.

More preferably, the method further comprises switching from the seventh mode of operation or the eighth mode of operation to a ninth mode of operation, in which the third potential is coupled to a third dummy load. Where the ninth mode of operation and the sixth mode of operation do not occur at the same time, the third dummy load is optionally the same as the second dummy load. Where the ninth mode of operation and the third mode of operation do not occur at the same time, the third dummy load is optionally the same as the first dummy load.

Preferably, the method further comprises: generating a fourth potential from a fourth power supply; and switching from a tenth mode of operation in which the fourth potential is coupled to the mass analyser, to an eleventh mode of operation in which the fourth potential is not coupled to the mass analyser. Advantageously, the fourth potential has the same polarity as the second potential and the tenth mode of operation is used whilst the fifth mode of operation is used.

More preferably, the method further comprises switching from the tenth mode of operation or the eleventh mode of operation to a twelfth mode of operation, in which the fourth potential is coupled to a fourth dummy load. Where the twelfth mode of operation and the third mode of operation do not occur at the same time, the third dummy load is optionally the same as the first dummy load. Where the twelfth mode of operation and the sixth mode of operation do not occur at the same time, the third dummy load is optionally the same as the second dummy load.

In a related aspect, there is provided a mass spectrometer, comprising: a mass analyser; a first power supply, arranged to generate a first potential; a second power supply, arranged to generate a second potential; a dummy load; a first switch, having a first mode of operation, in which the first potential is coupled to the mass analyser, and a second mode of operation in which the first potential is not coupled to the mass analyser; a second switch, having a third mode of operation, in which the second potential is coupled to the dummy load, and a fourth mode of operation, in which the second potential is not coupled to the dummy load; and a controller, arranged to control the first power supply to continue to generate the said first potential when the first switch is operating in its second mode, and to control the second power supply to continue to generate the said second potential when the second switch is operating in its fourth mode; and wherein the controller is further arranged to control said first switch to switch from said first mode of operation to said second mode of operation at least once during a predefined time period and to control said second switch to switch from said third mode of operation to said fourth mode of operation at least once during the predefined time period.

Advantageously, the dummy load comprises a resistor. Optionally, the dummy load comprises a resistor in parallel with one or both of: a capacitor; and an inductance.

Further provided is a mass spectrometer, comprising: a mass analyser; a first power supply, arranged to generate a first potential of non-zero magnitude $V_1$ and of a first polarity; a second power supply, arranged to generate a second potential of non-zero magnitude $V_2$ and of a second, opposed polarity; and a controller, arranged to supply the first potential to the mass analyser, and to switch the potential supplied to the mass analyser directly between the said first potential of non-zero magnitude $V_1$, in a first mode of operation, and the said second potential of non-zero magnitude $V_2$, in a second mode of operation.

A method of switching between first and second modes of power supply to a mass analyser is also conceived, comprising: in a first mode of operation, coupling a first potential generated by a first power supply to the mass analyser, whilst a second power supply generates a second potential but is disconnected from the mass analyser; in a second mode of operation, coupling a second potential generated by a second power supply to the mass analyser, whilst the first power supply generates the first potential but is disconnected from the mass analyser; and switching from the first mode of operation to the second mode of operation, such that only one of: the first potential; or the second potential is coupled to the mass analyser at any time.

Preferably, the polarity of the first potential is opposite to that of the second potential. The two accurate potentials can therefore be used for the analysis of both positive and negative charged particles.

A method of providing a potential to a mass analyser of a mass spectrometer is additionally conceived, comprising: generating a first potential of non-zero magnitude $V_1$ and of a first polarity; generating a second potential of non-zero magnitude $V_2$ and of a second, opposed polarity; supplying the first potential to the mass analyser; and switching the potential supplied to the mass analyser directly between the said first potential of non-zero magnitude $V_1$, in a first mode of operation, and the said second potential of non-zero magnitude $V_2$, in a second mode of operation.

By generating two separate potentials of opposite polarities and directly switching between them, such that the mass analyser is not coupled to any other potential or allowed to be at an indeterminate potential for any significant length of time between being connected from one potential to the other potential, there is no need to wait for power supplies to warm up before making use of an accurate potential in a mass analyser.

Optionally, the non-zero magnitude $V_1$ is equal to the non-zero magnitude $V_2$.

A combination of these aspects is also possible.

BRIEF DESCRIPTION OF THE DRAWINGS

The invention may be put into practice in various ways, one of which will now be described by way of example only and with reference to the accompanying drawings in which.

SPECIFIC DESCRIPTION OF A PREFERRED EMBODIMENT

Figure 1:
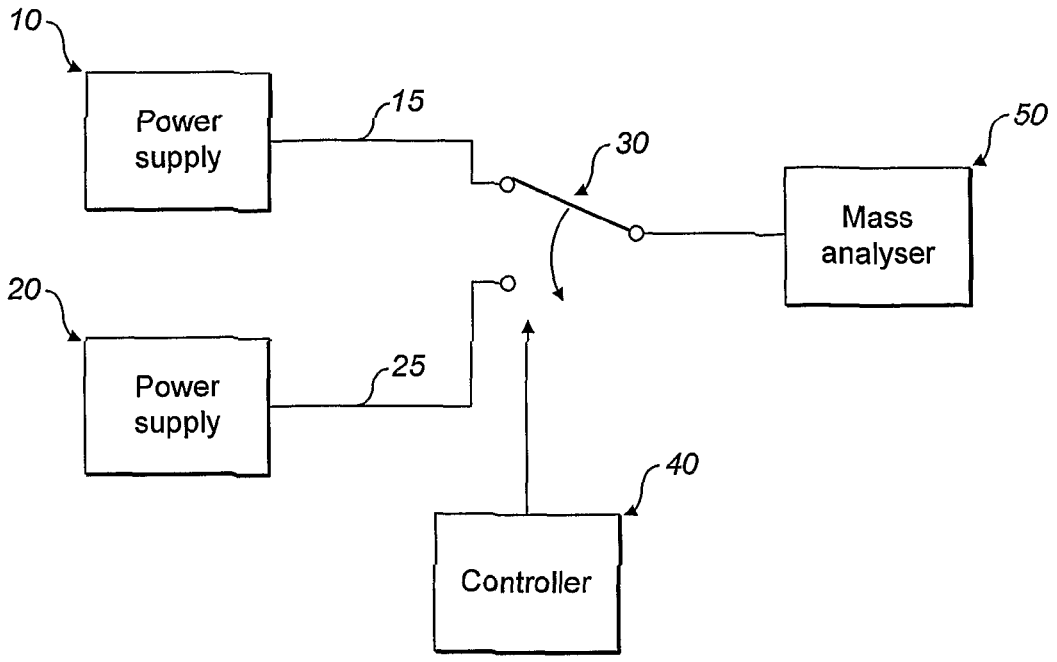
FIG. 1 shows a schematic diagram of a mass spectrometer according to the present invention.

Referring now to FIG. 1, there is shown a schematic diagram of a mass spectrometer, comprising a first power supply 10, a second power supply 20, a switch 30 controlled by controller 40, and a mass analyser 50. The first power supply operates to generate a first potential 15 and the second power supply operates to generate a second potential 25.

The first power supply 10 and second power supply 20 operate continuously. The first potential 15 has a negative polarity with respect to a ground potential and the second potential 25 has a positive polarity with respect to a ground potential. The first potential can be used for the analysis of positive ions in the mass analyser 50 and the second potential can be used for the analysis of negative ions in mass analyser 50. The controller 40 ensures that within a predefined time period both first potential 15 and second potential 25 are connected to the mass analyser 50 at least once.

Figure 2:
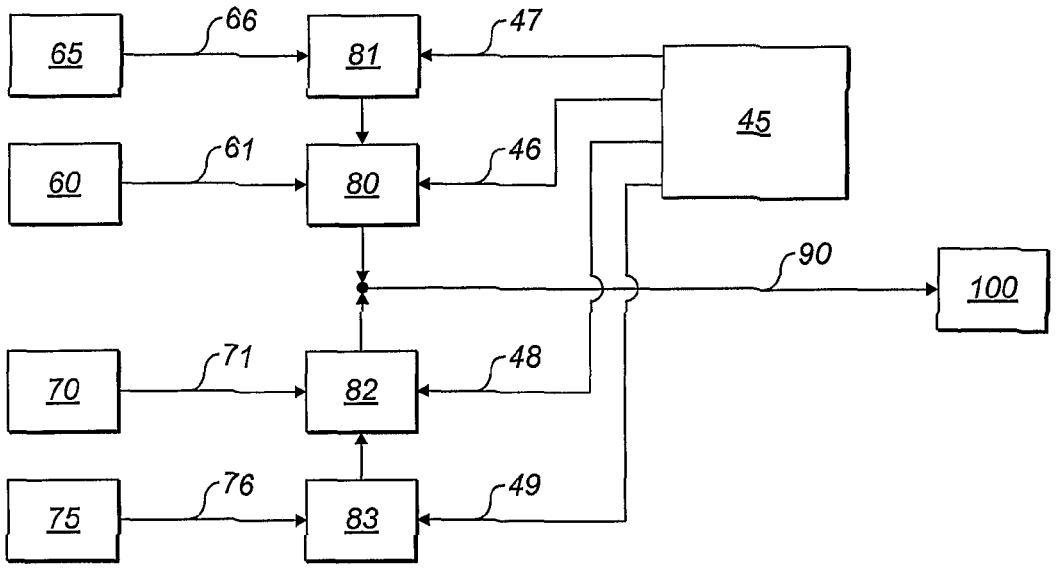
FIG. 2 shows a more detailed schematic illustration of the embodiment of FIG. 1.

The skilled person will recognise that FIG. 1 is somewhat simplified in order to illustrate the key features of the invention. In FIG. 2, there is shown a more detailed schematic illustration of the embodiment of FIG. 1. For example, the skilled person will understand that where an Orbitrap™ type mass analyser 100 is used, more than one potential is required. A coarse potential can be used for generating an electric field for ion capture, whilst an accurate potential is used to provide a stable electric field for ion measurement.

First coarse power supply 60 provides a negative coarse potential 61 and second coarse power supply 70 provides a positive coarse potential 71. First accurate power supply 65 provides a negative accurate potential 66 and second accurate power supply 75 provides positive accurate potential 76. The potentials provided by each of these power supplies is regulated.

Controller 45 controls high voltage (HV) switches 80, 81, 82 and 83. Negative coarse potential 61 is provided to first HV switch 80 and controller 45 provides first switching signal 46 to control this switch. Negative accurate potential 66 is provided to second HV switch 81 and controller 45 provides second switching signal 47 to control this switch.

Positive coarse potential 71 is provided to third HV switch 82 and controller 45 provides third switching signal 48 to control this switch. Positive accurate potential 76 is provided to fourth HV switch 83 and controller 45 provides fourth switching signal 49 to control this switch.

The output from the second HV switch 81 and fourth HV switch 83 are connected together and provided as output 90 to mass analyser 100. First switching signal 46 and second switching signal 47 cannot be provided at the same time as third switching signal 48 and fourth switching signal 49. In other words, output 90 can only be either a positive potential or a negative potential at any one time.

In this preferred embodiment, negative accurate potential 66 is −5 kV and positive accurate potential 76 is +5 kV. The stability of these two potentials is high (typically +/−2 ppm). Negative coarse potential 66 and positive coarse potential 76 are about 800-1800V lower in magnitude than the respective accurate potential. The stability of the coarse potentials is much less than that of the accurate potentials (for example, +/−20-30 ppm). These four power supplies are independently regulated, which improves the stability of the multiple outputs and, in particular, improves decoupling of the coarse power supplies from the accurate power supplies.

This allows the first coarse power supply 60 or second coarse power supply 70 to supply a much higher charge for recharging of the mass analyser load capacitance (about 50 to 100 pF, including wires plus capacitance of associated transistors) over 80% of the entire voltage range. Then, the negative accurate power supply 65 or positive accurate power supply 75 has only a small part of voltage range left to recharge.

Figure 3:
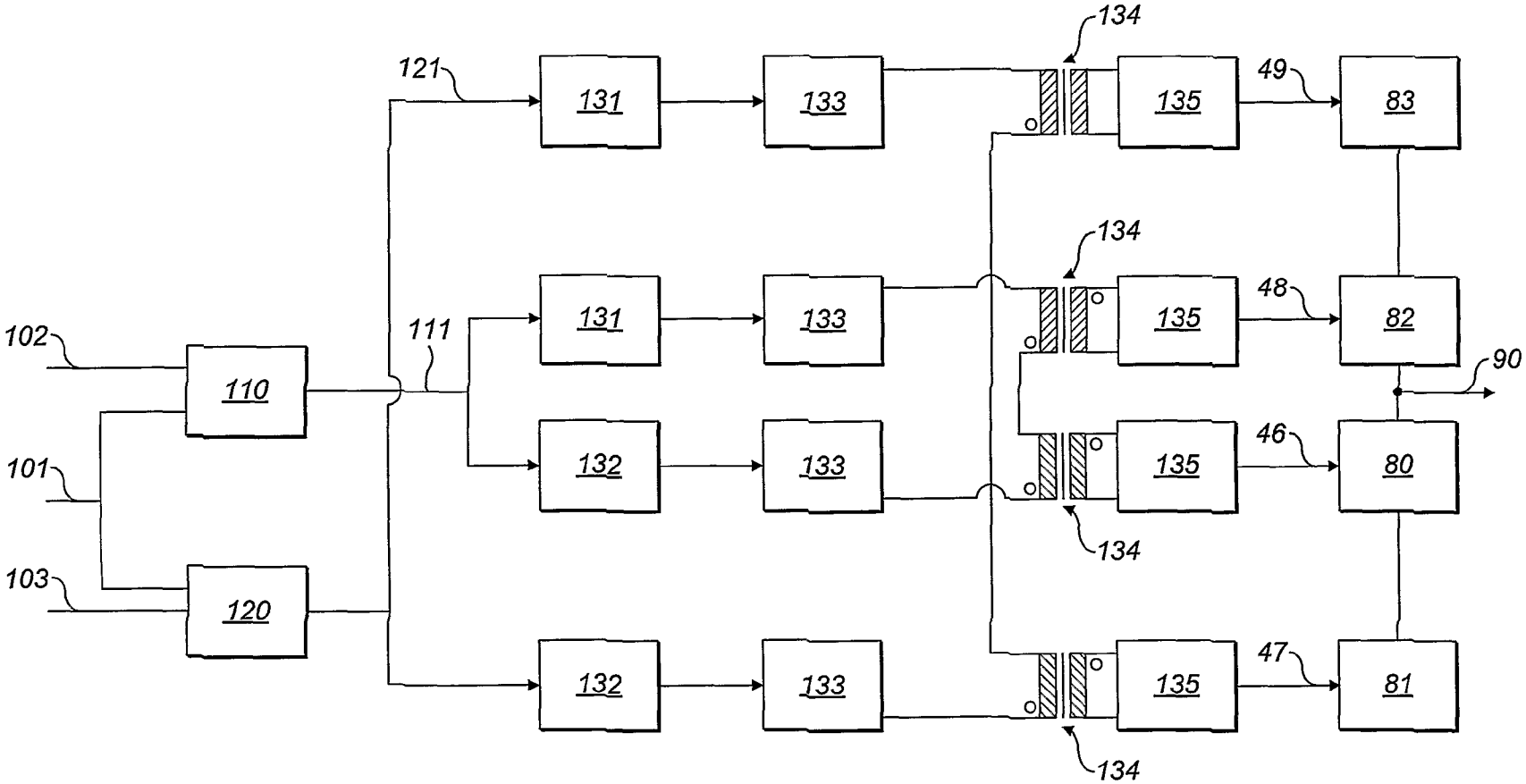
FIG. 3 shows a controller for use in the embodiment of FIG. 2.

The method of operation of the mass spectrometer can be better understood in the design of the controller 45. In FIG. 3, there is shown a controller, having three input signals, which are used to control the output 90. A polarity signal 101 indicates the polarity of the output 90, a coarse supply trigger signal 102 indicates that the output 90 should comprise the coarse power supply output and an accurate supply trigger signal 103 indicates that the output 90 should comprise the accurate power supply output.

Gate 110 receives the polarity signal 101 and coarse trigger signal 102, and generates a coarse supply control signal 111. Gate 120 receives the polarity signal 101 and accurate trigger signal 103, and generates an accurate supply control signal 121.

Two rising-edge detectors 131 are provided, which detect the input changing from a low logic level to a high logic level. One rising-edge detector 131 receives coarse supply control signal 111 and the other rising-edge detector 131 receives accurate supply control signal 121.

Two falling-edge detectors 132 are also provided, which detect the input changing from a high logic level to a low logic level. One falling-edge detector 132 receives coarse supply control signal 111 and the other falling-edge detector 132 receives accurate supply control signal 121.

The outputs of each of the rising-edge detectors 131 and falling-edge detectors 132 are provided to a respective transistor output stage 133. The outputs of the transistor output stages 133 are provided to isolators 134, which are in this case transformers. The outputs of the isolators 134 are each provided to a respective charge accumulator 135. These provide first switching signal 46, second switching signal 47, third switching signal 48 and fourth switching signal 49.

Figure 4:
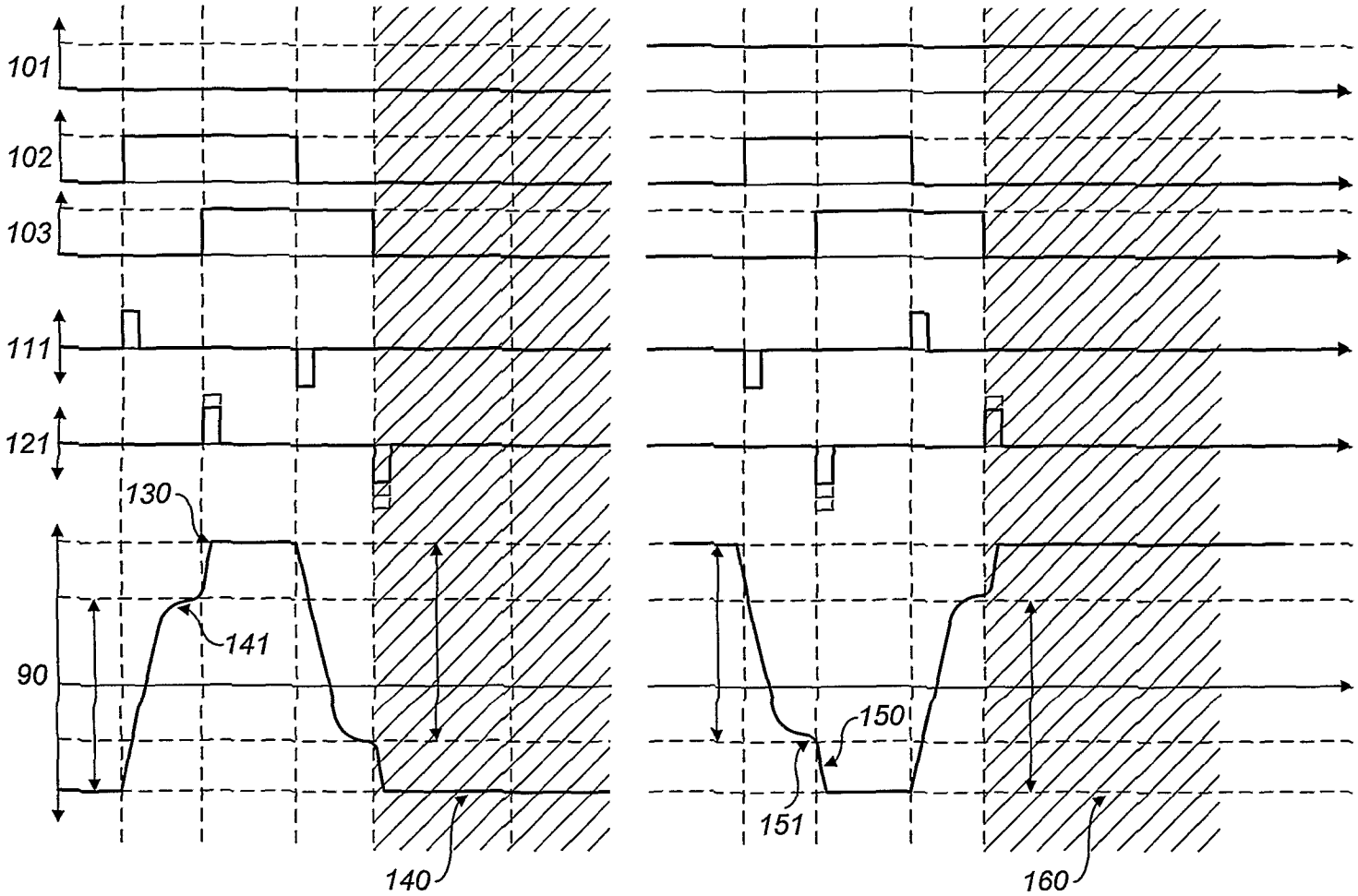
FIG. 4 shows exemplary signals used in the controller of FIG. 3.

The operation of controller 45 may be better understood with reference to the signals generated in the controller during normal operation. Turning to FIG. 4, there is shown exemplary signals used in the controller 45.

FIG. 4 is divided into two. On the left hand side of FIG. 4, polarity signal 101 is low, indicating negative polarity. The output 90 is initially provided by the potential of the negative accurate power supply. Coarse supply trigger signal 102 initially changes from a low logic level to a high logic level, which leads to a positive pulse in coarse supply control signal 111. This causes the output 90 to increase from the potential of the accurate negative supply towards the coarse positive potential level, the accurate negative power supply being switched out. The output 90 approaches towards a constant voltage for a short time period 141 and may settle at this voltage for a portion of the time period 141. After a delay of 10-10000 microseconds relative to the start of the coarse supply trigger signal 102, the accurate supply trigger signal 103 changes from low to high. This causes a positive pulse in the accurate supply control signal 121 and leads to the level of output 90 increasing to that of the positive accurate supply potential, the positive coarse power supply being still connected.

After some time, the coarse supply trigger signal 102 transitions from a high logic level to a low logic level. This causes a negative pulse in the coarse supply control signal 111 and leads to the level of output 90 decreasing by the potential of the negative coarse power supply, the positive accurate power supply and the positive coarse power supply both being switched out. Following a further delay, the accurate supply trigger signal 103 transitions from a high logic level to a low logic level. This leads to a negative pulse in the accurate supply control signal 121 and causes the level of output 90 to reduce to the level of the negative accurate power supply, the coarse negative power supply being still connected.

On the right hand side of FIG. 4, polarity signal 101 is high, indicating positive polarity. The output 90 is initially provided by the potential of the positive accurate power supply. Coarse supply trigger signal 102 initially changes from a low logic level to a high logic level, which leads to a negative pulse in coarse supply control signal 111. This causes the output 90 to decrease towards the coarse negative potential level. The output 90 approaches a constant voltage for a short time period 151 and may settle at this voltage for a portion of the time period 151. After a delay of 10-10000 microseconds relative to the start of the coarse supply trigger signal 102, the accurate supply trigger signal 103 changes from low to high. This causes a negative pulse in the accurate supply control signal 121 and leads to the level of output 90 decreasing to that of the accurate negative supply potential, the coarse negative power supply being still connected.

After a further delay, the coarse supply trigger signal 102 changes from a high logic level to a low logic level. This causes a positive pulse in the coarse supply control signal 111 and leads to the level of output 90 increasing to the level of the coarse positive supply potential, the accurate negative power supply and coarse negative power supply both being switched out. Finally, the accurate supply trigger signal 103 transitions from a high logic level to a low logic level. This leads to a positive pulse in the accurate supply control signal 121 and causes the level of output 90 to increase to the potential of the accurate positive power supply, the coarse positive power supply being still connected.

As can be seen from FIG. 4, only two types of slopes exist. The first is a "downward slope", which could be used for injection of negative ions at time 130, followed by detection of the negative ions at time 140. The other is an "upward slope", which could be followed by injection of positive ions at time 150 and measurement of positive ions at time 160.

As can be observed from FIG. 4, the coarse power supplies provide most of the required voltage difference, when a transition occurs, thus protecting the faster-switching and more accurate supply from unnecessary load.

Figure 5:
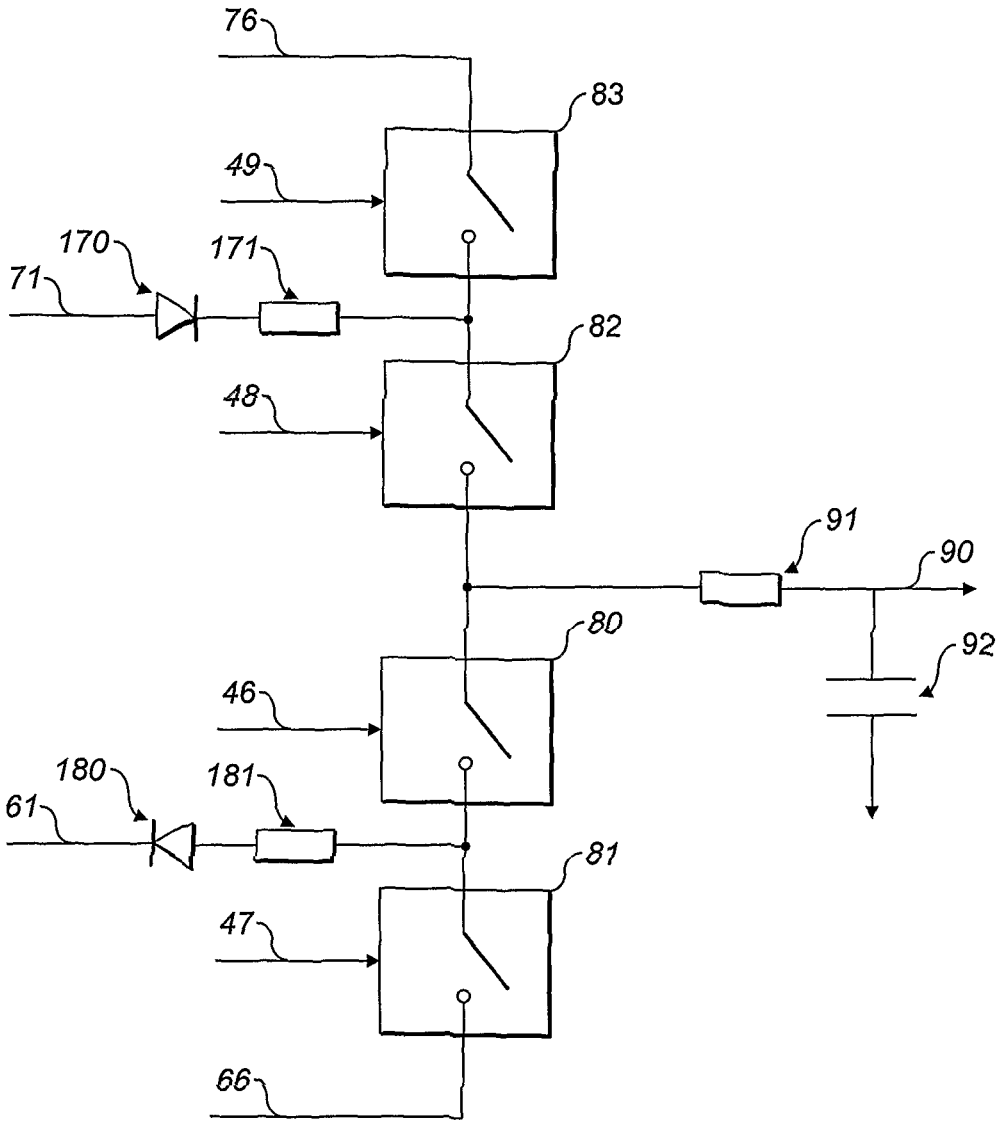
FIG. 5 shows a schematic switching arrangement for use in the embodiment of FIG. 2.

Turning to FIG. 5, there is shown a schematic switching arrangement. Where identical components to those in FIGS. 2 and 3 are indicated, the same reference numerals are used. This illustration shows the system in an "idle" state (all the switches being set in an 'off' position). When one of the coarse trigger signals is set to a high logic level, the system switches from the positive branch to the negative branch or vice versa, depending on the state of the polarity signal. When one of the accurate trigger signals is set to a high logic level, the respective accurate potential is added by closing the respective switch. A resistor 91 and capacitor 92 act as a low-pass filter and control the voltage slope at the output 90.

The gradients of the slopes on transition between one potential and the opposite potential are controlled by resistor 171 and resistor 181 in the line providing the coarse positive power supply output 76 and coarse negative power supply output 66 respectively. Diode 170 and diode 180 prevent parasitic reverse currents through the coarse power supply outputs due to the respective accurate power supply, which may damage the coarse power supplies. Consequently, each of the coarse power supply does not provide a source of noise when connected in parallel with the respective polarity accurate power supply. The reasons for this are that: diode 170 and diode 180 provide protection through their reverse bias; the effect of instabilities are dampened by resistor 171 and 181; and the accurate power supplies' outputs are regulated and this would compensate any remaining effects. In fact, the coarse power supplies are not actually sources of noise, but rather, are less effectively regulated than the accurate power supplies.

In the preferred implementation, the arrangement shown in FIG. 5 operates in the following way. At a first step, third switching signal 48 causes third HV switch 82 to be closed. All three other switches are left open, such that the output 90 increases towards the coarse positive potential 71.

At a second step, third switching signal 48 and fourth switching signal 49 cause third HV switch 82 and fourth HV switch 83 to be closed. The other two switches are open, such that the output 90 increases towards the positive accurate potential 76. At a third step, the first switching signal 46 causes first HV switch 80 to be closed. All other switches are opened, such that output 90 decreases towards the coarse negative potential 61.

At a fourth step, first switching signal 46 and second switching signal 47 cause first HV switch 80 and second HV switch 81 to be closed. The other two switches are open, such that the output 90 decreases towards the negative accurate potential 66.

Figure 6:
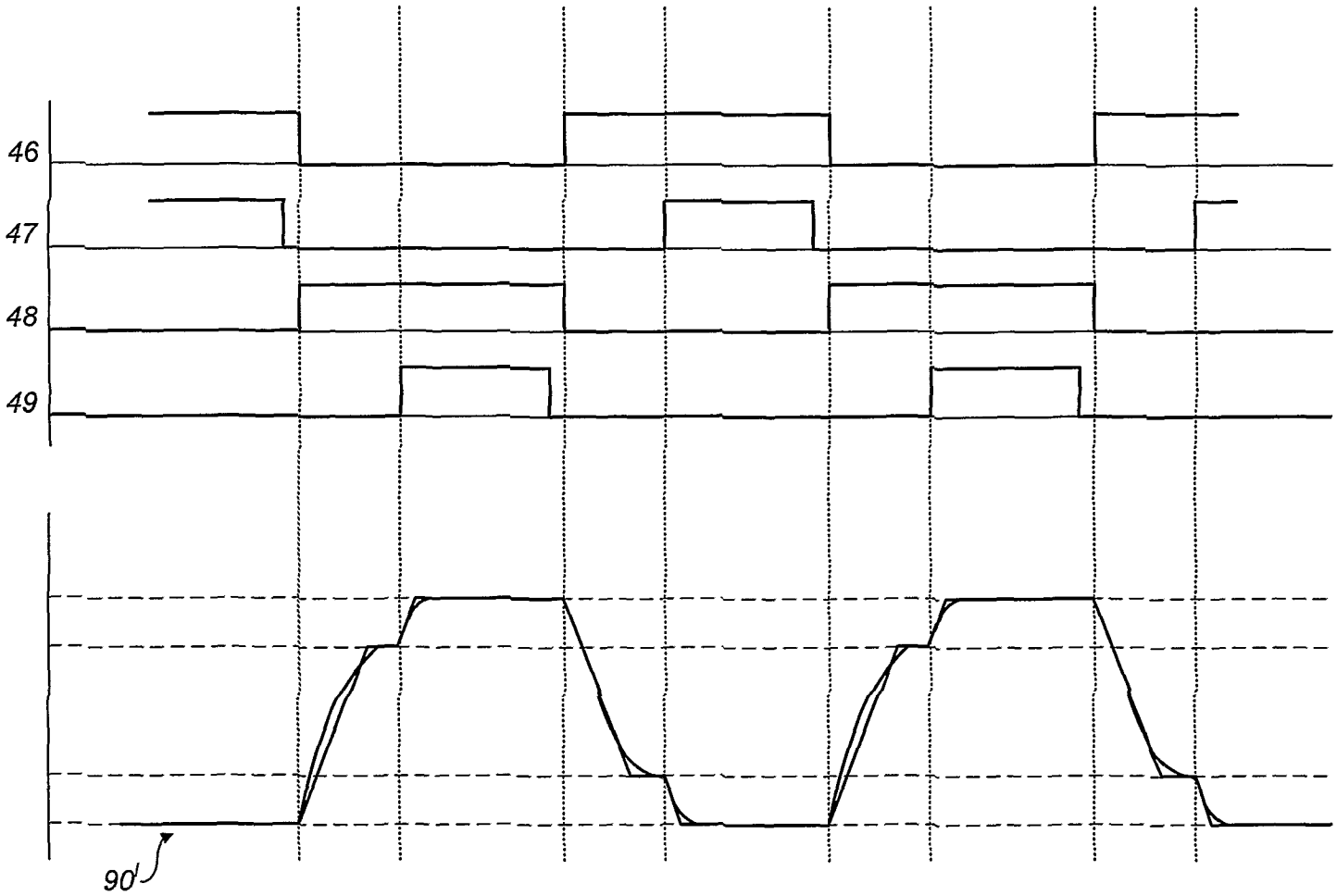
FIG. 6 shows exemplary signals for use in the schematic switching arrangement of FIG. 5.

Referring now to FIG. 6, there is shown exemplary signals for use in the schematic switching arrangement of FIG. 5. The signals are identified by the same reference numerals as the corresponding signals of FIG. 5. When these signals are used, output signal 90' results. This signal arrangement can achieve higher voltage accuracy and faster switching.

Whereas the embodiment shown in FIG. 3 uses two control signals (coarse supply control signal 111 and accurate supply control signal 121) where rising and falling edges are triggering events, the embodiment of FIG. 5 uses four control lines (first switching signal 46, second switching signal 47, third switching signal 48, fourth switching signal 49). Using additional control signals increases the flexibility of the system to operate and allows faster rise times. The present invention may be used for a variety of applications. The applications may include: providing a potential to an electrode (including dynodes) or grid in a mass analyser; supplying voltages to the centre electrode of an Orbitrap™-type mass analyser; supplying voltages to other electrodes of an Orbitrap™-type mass analyser (for example, deflector, curved ion trap, ion gates); supplying voltages to electrodes in electrostatic mass analyzers, Time-Of-Flight (TOF) mass analyzers, including multi-reflection or multi-deflection types; supplying voltages to a Bradbury Nielsen gate; supplying voltages to a deflector; supplying voltages for use as a detector offset; supplying voltages for extraction electrodes (including grids) in TOF instruments; and supplying voltages to switchable mirrors or sectors in single or multiple reflection TOF instruments.

This embodiment therefore operates based on the following approach. The power supplies are cyclically connected to the central electrode of an Orbitrap™ mass analyzer 100, in a cycle of the type shown in FIG. 4 or FIG. 6. The ions are injected into the mass analyzer 100 during the slope at time 130 or the slope at time 150 (depending on charge state). Ions of different mass arriving at different times are thus captured into stable orbits around the central electrode of the mass analyser 100. This is explained in more detail in Hardman, M. & Makarov, A. A.: Interfacing the Orbitrap Mass Analyzer to an Electrospray Ion Source; Anal. Chem., 2003, 75, 1699-1705. In this way, the combination of accurate and coarse power supplies also serves the purpose of controlling injection and capture of ions in the Orbitrap™ mass analyzer 100. The slope of this voltage rise is controlled by resistor 91 and capacitor 92 in combination with the resistive, capacitive and inductive load of the mass analyzer 100 and wiring.

Whilst a specific embodiment has been described herein, the skilled person may contemplate various modifications and substitutions. For example, the skilled person will readily appreciate that the switches shown in FIG. 5 could be relays, transistors or solid state switches.

The skilled person will also understand that it may be desirable to provide the mass analyser with other high voltages at multiple polarities, which do not require high accuracy and/or have significantly lower amplitude than those required for the electric field, for example lenses and pulsers. These could provided with switched polarity using conventional approaches, or the technique described above could be applied.

The skilled person will recognise that, in the operation of FIG. 5, after the second step the system may return to the "idle" state. This may be used to aid in avoiding the possibility of two power supplies of opposite polarity being connected to the load at the same time. The "idle" state may therefore protect the power supplies against damaging reverse currents of opposite polarity. Additionally, the system may return to the "idle" state after the fourth step, and following that, the first step can then begin again. The skilled person will understand that, in the "idle" state, the potential of the electrode that has been disconnected from the power supply or power supplies will first remain at the same potential and will then decay into an undefined state. Thus, it is not normally desirable to remain in the "idle" state for prolonged times.

In an alternative approach of operation to that described above, a network of the type shown in FIG. 5 is connected to a pulser electrode of a Time-of-Flight mass spectrometer, such as an electrode in an orthogonal accelerator which injects ions onto the flight path. The power supply output cycle is similar to that shown in FIG. 4 or FIG. 6. Ions are, for example, injected into the orthogonal accelerator (or an injector trap) during the period of constant voltage 141 (or period of constant voltage 161). Alternatively in an embodiment as shown in FIG. 5, the timing of the control signals could be adjusted to include a 'hold' time, where the ions are injected during hold on the respective coarse power supply and then pulsed onto the flight path by the slopes 130 or 150 respectively.

Depending on the conditions, a further 'rest' point may be introduced at or near ground, either by connecting the electrode directly to ground at that time, or by use of an additional power supply providing virtual ground. The ions would than be injected into the pulser (orthogonal accelerator, linear ion trap or non-linear trap) prior to the ejection pulse.

Figure 7:
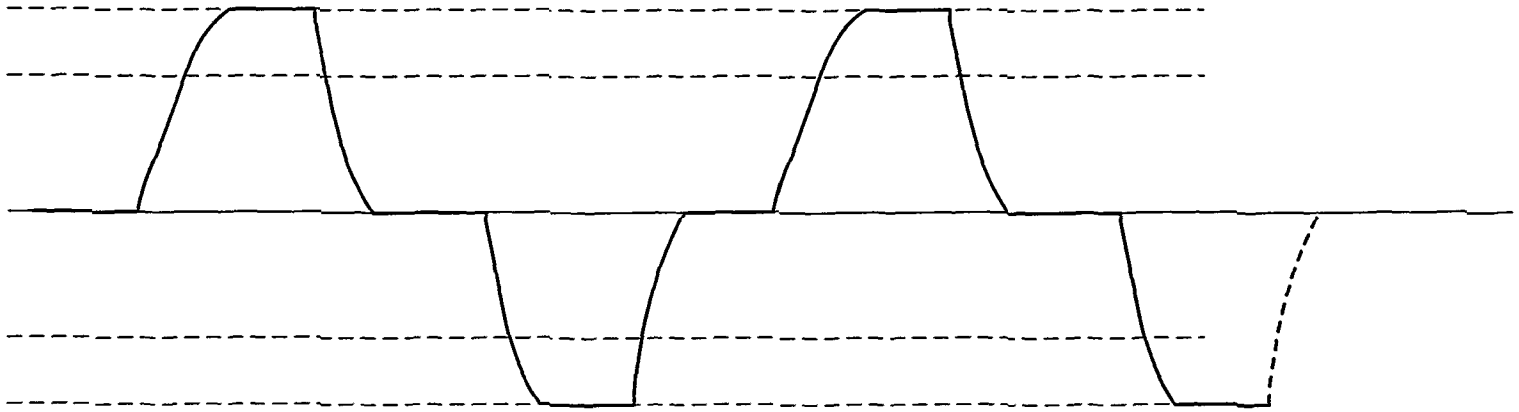
FIG. 7 shows an alternative output signal from the schematic switching arrangement of FIG. 5.

Referring now to FIG. 7, there is shown an alternative output signal from the schematic switching arrangement of FIG. 5. This output signal allows a further resting point, where the voltage supplied to the mass spectrometer electrode is stable. The first half of the shown signal relates to the case where only two power supplies are used. In contrast, the second half relates to the use of four power supplies, which results in a characteristic "notch" or "dent" in the output signal.

This single or dual step pulse would then introduce ions onto the detection trajectory with accurately defined energy. The same principle can be used for an 'energy lift' during injection of ions into a Time-of-Flight mass analyzer.

Similarly the invention can be applied to other components of a Time-of-Flight (TOF) mass analyzer, such as the electrodes of an ion mirror or deflector of a reflectron, multi-reflecting or multi-turn TOF-device, thus allowing faster change between positive and negative ion mode.

Although the preferred embodiments of the present invention connect each of the power supplies to the mass analyser on a regular basis, the skilled person will recognise that a load having an impedance which is matched to that of the mass analyser may be used as a substitute. This is termed a dummy load. It has been found that there are considerable difficulties in modelling the impedance of the mass analyser so as to create a dummy. In particular, manufacturing tolerances allow the characteristic impedance to differ between mass analysers. Moreover, modelling the impedance of an Orbitrap™-type mass analyser has been found to present a significant challenge.

Consequently, the use of a dummy load, is not a preferred embodiment. Nevertheless, the skilled person will recognise that a dummy load might be used, rather than connecting a power supply that is not required to provide a potential for mass analysis to the mass analyser.

Figure 8:
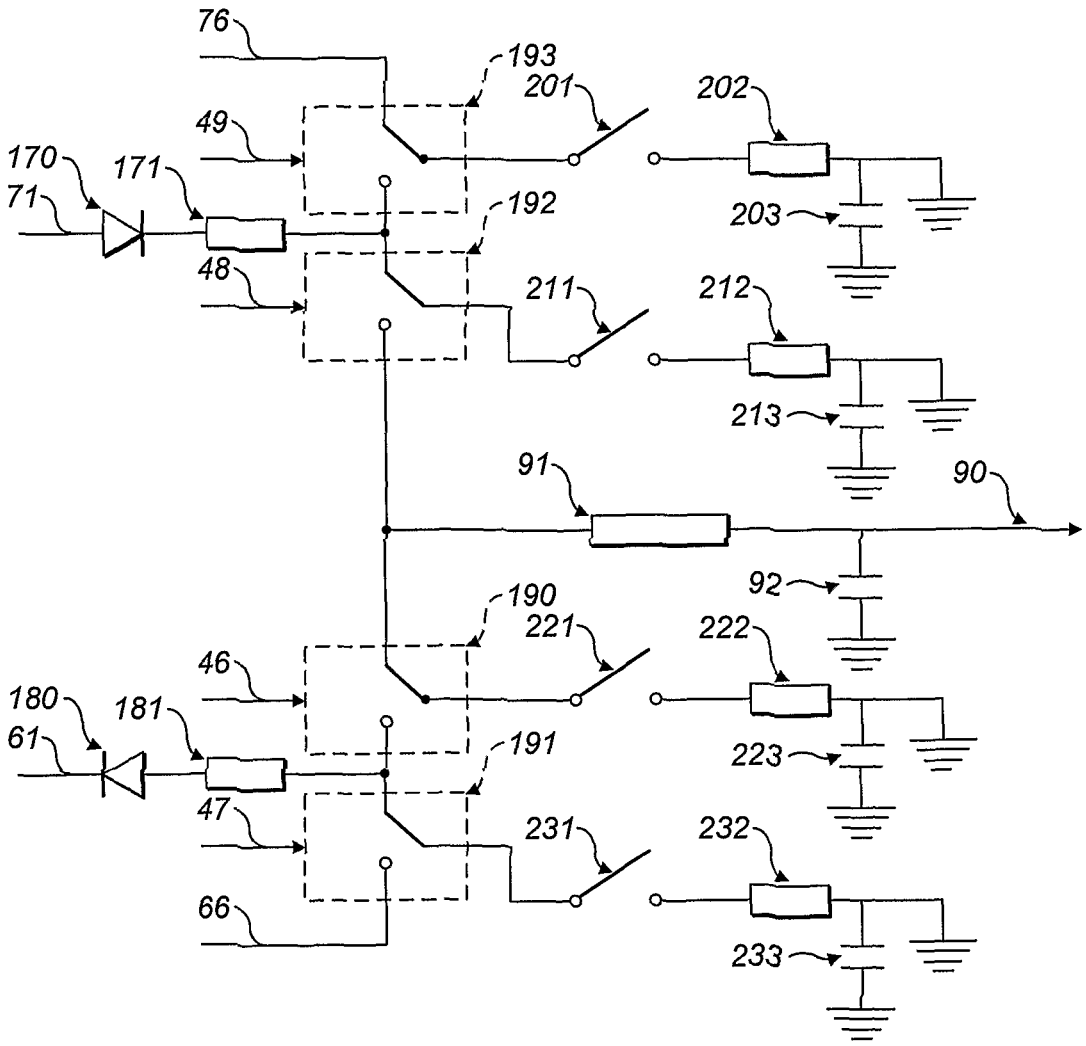
FIG. 8 shows an alternative embodiment of the present invention.

Referring now to FIG. 8, there is shown an alternative embodiment of the present invention, based on this concept. This alternative embodiment is similar to FIG. 5, and where the same features are shown, identical reference numerals are used. High voltage (HV) switches 190, 191, 192 and 193 can connect the outputs of the four power supplies, potentials 61, 71, 66 and 76, to either the output 90 or to a dummy load.

In this embodiment, an individual dummy load is provided for each power supply. Additional switches 201, 211, 221 and 231 are provided for controlling the connection to each respective dummy load resistor 202, 212, 222 and 232. A respective capacitor 203, 213, 223 and 233 is provided in parallel with each dummy load resistor 202, 212, 222 and 232.

The "idle" state of the HV switches 190, 191, 192 and 193 0 is connected to a respective dummy load resistor 202, 212, 222 and 232. Additional switches 201, 211, 221 and 231 are optional. The dummy load resistor 202, 212, 222 and 232 can be any model of the real load (that provided by the mass analyser 50 or Orbitrap™ mass analyser 100), including a copy of the real load, such as a production model that does not match the accuracy requirements for an Orbitrap™ mass analyzer. Alternatively, a network of resistances, capacitances and inductances can be used.

Also, there need not be one dummy load per power supply. Fewer dummy loads may be used, dependent on the actual requirements and cost. For example, only one dummy load could be used, or one dummy load per polarity, or only the accurate power supplies could be connected to the dummy load. In an alternative mode of operation, the accurate power supplies can be cyclically connected to the mass analyzer, and the coarse power supplies connected to the dummy load or dummy loads.

The invention claimed is:

1. A method of switching between first and second modes of power supply to a mass analyser, comprising:

operating in a first mode of operation for a first predefined time duration, wherein in the first mode of operation:

a first non-zero potential generated by a first power supply is coupled to the mass analyser, while a second power supply generates a second non-zero potential but is disconnected from the mass analyser;

an electric field is generated in the mass analyser using the first potential;

charged particles are received at the mass analyser; and the charged particles are analysed; and subsequent to operating in the first mode of operation, switching to a second mode of operation for a second predefined time duration, wherein in the second mode of operation, the second non-zero potential generated by the second power supply is coupled to the mass analyser, while the first power supply generates the first potential but is disconnected from the mass analyser;

wherein the first predefined time duration and second predefined time duration are selected such that only one of the first potential and the second potential is coupled to the mass analyser at any time, and such that the steps of operating in the first mode of operation and the second mode of operation are carried out at least once within a predetermined length of time; and wherein the polarity of the first potential is opposite to the second potential.

2. The method of claim 1, wherein the said first non-zero potential is equal in magnitude to the said second non-zero potential.

3. The method of claim 1, wherein the length of the second predefined time duration is no longer than the length of the first predefined time duration.

4. The method of claim 1, wherein the length of the first predefined time duration is substantially equal to the length of the second predefined time duration.

5. The method of claim 1, wherein the length of the first predefined time duration is based on the length of time taken to perform the steps of receiving charged particles and generating the electric field so as to permit analysis of the charged particles.

6. The method of claim 1, wherein the length of the second predefined time duration is independent of the polarity of the charged particles received at the mass analyser during the first predefined time duration.

7. The method of claim 1, further comprising:

generating a third potential of the same polarity as said first potential; and wherein in said first mode of operation, the first potential is coupled to the mass analyser, but the third potential is not coupled to the mass analyser, during a first period of time, the first period of time being at least a subset of the first predefined time duration.

8. The method of claim 7, wherein in the first mode of operation, the first potential and the third potential are coupled to the mass analyser during a second period of time, the second period of time being a subset of the first predefined time duration.

9. The method of claim 8, wherein the second period of time precedes the first period of time, and wherein a power supply continues to generate the third potential during the first period of time.

10. The method of claim 7, wherein a power supply continues to generate the third potential during the second mode of operation.

11. The method of claim 7, wherein the magnitude of third potential is greater than that of the first potential.

12. The method of claim 7, wherein the third potential is generated by a third power supply and wherein the accuracy of the first power supply is greater than that of the third power supply.

13. The method of claim 1, wherein the mass analyser is of an Orbitrap type.

14. The method of claim 1, wherein the mass analyser is of a time of flight type.

15. The method of claim 14, wherein the mass analyser comprises an electrostatic trap.

16. A mass spectrometer, comprising:

a mass analyser;

a first power supply, arranged to generate a first non-zero potential;

a second power supply, arranged to generate a non-zero second potential; and a switch, having a first mode of operation in which the switch is arranged to couple the first potential to the mass analyser and to disconnect the second potential from the mass analyser, and a second mode of operation in which the switch is arranged to couple the second potential to the mass analyser and to disconnect the first potential from the mass analyser, such that only one of the first potential or the second potential is coupled to the mass analyser at any time; and a controller, arranged to configure the switch to its first mode of operation for a first predefined time duration, to control the mass analyser to receive charged particles during the first predefined time duration, and to control the mass analyser to analyse the charged particles during the first predefined time duration, and the controller further arranged to configure the switch to its second mode of operation for a second predefined time duration subsequent to the first predefined time duration, the first predefined time duration and second predefined time duration being selected such that the first mode of operation and the second mode of operation are carried out at least once within a predetermined length of time; and wherein the second power supply is arranged to continue to generate the said second potential when the switch is arranged in its first mode of operation, and wherein the first power supply is arranged to continue to generate the said first potential when the switch is arranged in its second mode of operation; and wherein the polarity of the first potential is opposite to the second potential.

* * * * *